US007377204B2

(12) United States Patent
Simmons

(10) Patent No.: US 7,377,204 B2
(45) Date of Patent: May 27, 2008

(54) SAFER MUNITIONS WITH ENHANCED VELOCITY

(75) Inventor: John Castle Simmons, Germantown, TN (US)

(73) Assignee: John C. Simmons, Germantown, TN (US)

( * ) Notice: Subject to any disclaimer, the term of this patent is extended or adjusted under 35 U.S.C. 154(b) by 577 days.

(21) Appl. No.: 10/080,094

(22) Filed: Feb. 21, 2002

(65) Prior Publication Data

US 2004/0107826 A1 Jun. 10, 2004

(51) Int. Cl.
*F41F 1/00* (2006.01)

(52) U.S. Cl. ..... 89/8; 89/14.6; 102/522

(58) Field of Classification Search ..... 102/520, 102/521, 522, 523; 89/8, 14.6
See application file for complete search history.

(56) References Cited

U.S. PATENT DOCUMENTS 2,382,152 A * 8/1945 Jakobsson ..... 102/523
3,011,404 A * 12/1961 Russell ..... 89/1.1
3,138,991 A * 6/1964 Malter ..... 89/14.3
3,468,216 A * 9/1969 Charpentier ..... 89/8
4,063,486 A * 12/1977 Ashley ..... 89/7
4,706,569 A * 11/1987 Wallow et al. ..... 102/518
5,221,809 A * 6/1993 Cuadros ..... 102/439

FOREIGN PATENT DOCUMENTS

DE 38 24 524 A1 * 2/1990 ..... 102/522
EP 0 401 115 A1 * 12/1990 ..... 102/521
FR 496.879 * 11/1919 ..... 102/522
FR 801.987 * 8/1936 ..... 102/523
GB 121225 * 12/1918 ..... 102/522
GB 2 257 238 A * 1/1993 ..... 102/521

* cited by examiner

*Primary Examiner*—Stephen M Johnson

(57) ABSTRACT

An apparatus and process for providing exceptionally high velocity projectiles and safer, more accurate munitions. Inefficiencies in explosive oxidation rates and initial resistance to velocity acquisition are overcome.

6 Claims, 14 Drawing Sheets

Fins are flat and rear ends are sharply beveled perpendicular to vector of flight to facilitate effective propulsion through shaped, graphite treated fin-travel slits in Sabot.

Not drawn to scale or perspective. .

SAFER MUNITIONS WITH ENHANCED VELOCITY

BACKGROUND OF THE INVENTION

Projectiles that travel at extremely high speed provide substantial advantages. The laws of physics provide special advantages to hypervelocity projectiles and, even at sub-hypervelocity levels, every increase in velocity is an increase in range, accuracy, and penetrating power. It would seem that simply placing more charge behind the projectile would result in all the velocity you want. However, the fastest bullets in existence today rarely exceed 5000 feet per second at their maximum point of velocity due to offsetting effects that the current technologies are vulnerable to.

Once extremely high velocities are attained, they can be easier to maintain. However, in the process of reaching high velocities, nature restricts the inventor at every turn. As the typical bullet leaves the typical muzzle, the bullet is traveling faster than the gas which i s supposedly accelerating it. At that point, the gas is expending most of its energy maintaining its own expansion rather than adding velocity to the projectile. Massive, expensive, and involved assemblies of equipment too cumbersome and delicate for general use outside the laboratory have been the solution of choice to overcome these obstacles. Devices to accommodate large ratios of explosive load to payload diameter to maximize velocity, such as Sabots, which have encountered problems both in the barrel and under separation in mid-air, can decrease speed and accuracy as they wobble unsupported by the stability of the barrel at separation. The extremely small payloads currently possible at high speed are also a problem. Explosive charges that initiate gas compression to propel very tiny projectiles a very short distance under laboratory conditions have been the only truly successful means to date. These assemblies, however, are certainly not portable, require much expense, maintenance and setup.

The current invention provides the means to economically acquire the benefits of very high velocities while providing safer munitions. These advantages include minimizing the effects of wind on accuracy, greatly increased range, genuine straight line sighting, smaller individual charges, less volatile charges, larger potential payloads, safer Sabot disposal, further improved accuracy using special Sabot, increased penetrating power (with portable, potentially automatically firing equipment) and little or not special setup or modifications to existing firearms.

SUMMARY OF THE INVENTION

It is an object of the current invention to advance the art of Insensitive Munitions and provide a means to provide the same or greater power but with safer, more stable energetic materials thus reducing accidental explosion.

It is also an object of the current invention to eliminate much of the dependence on radioactive materials in the manufacturing of penetrating projectiles and to thus remove the hazards to nearby personnel of hazardous, radioactive airborne health hazards after impact.

It is also an object of the current invention to eliminate the potential hazards to friendly personnel caused by high-speed, in-flight Sabot discardation.

It is also an object of the current invention to overcome Sabot separation complications, their potentially negative effects on accuracy, and their negative effects on range while substantially increasing the velocity and penetrating power of the projectile.

It is an object of the current invention to provide a unique multistage process which maximizes the percentage of combustion that is applied to creating additive velocity which increases range, accuracy, and ease of sighting as it minimizes the problems of deflectance off of slanted target surfaces.

It is also an object of the current invention to initiate a detonation wave that can actually exceed the detonation rate of the charge material itself thus providing faster projectile acceleration with a wider range of explosive options.

It is also an object of the current invention to instantaneously apply previously wasted energy in hydraulically leveraged form to provide substantial additive velocity.

It is also an object of the current invention to eliminate the loss of velocity-additive thrust typically caused by cooling gases weakening compression as they mix with highly active combustion.

It is also an object of the current invention to provide multi-staged acceleration in conventional barrels, kinetics-enhanced combustion, and increased accuracy for many applications with no dependence on timing for firing reliability.

It is also an object of the current invention, while increasing velocity and payload, to reduce recoil and improve the stability of the firing platform.

Is also an object of the current invention to provide unique firing mechanisms capable of accurately firing a charge that is, itself, already moving at thousands of feet per second in such a manner as to provide the precisely timed and precision impact or other firing potential required to assure reliability in action without reducing velocity.

Is also an object of the current invention to provide a portable, powerful means of overcoming some of the natural enemies of initial velocity gain in certain devices.

It is also an object of the current invention to apply the multi-stages approach to deep penetration weapons, overcoming the problems of long-term maintenance of velocity and the buildup of destructive heat.

It is also an object of the current invention to increase both the reliability of firing and the speed of combustion of energetic material (thus increasing the end velocity of the projectile) by the addition of a completely portable apparatus and process requiring no field modifications to ignite and burn the material in a broad based, even-oxidation matrix rather than from point to end as is typically done.

It is also an object of the current invention to increase the potential size of the projectile while simultaneously decreasing its necessary size for any task thereby creating more effective power for limited size applications and substantially increased capacities for larger applications.

DESCRIPTION OF THE PREFERRED EMBODIMENT

Figure 1:
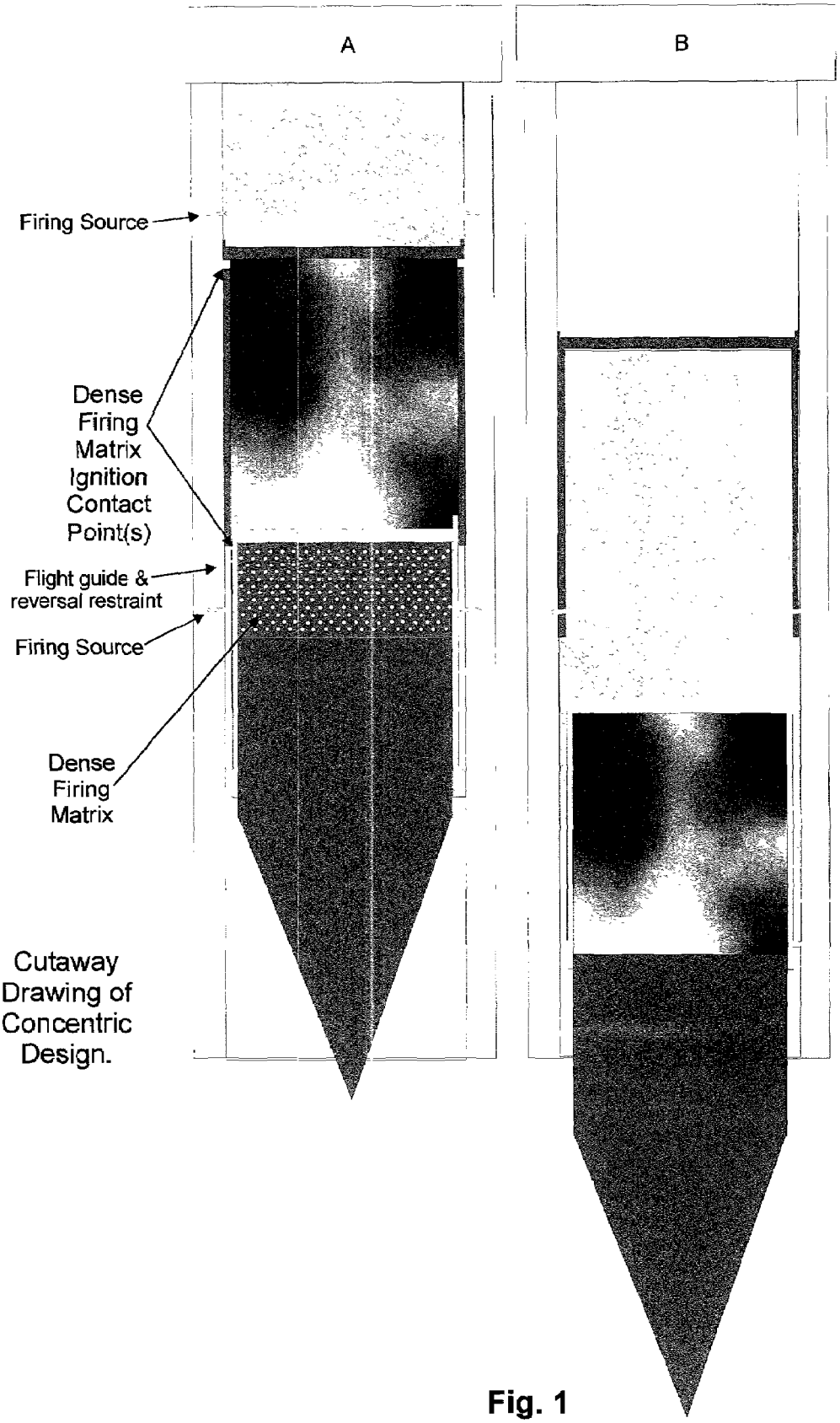
FIG. 1 illustrates a simple application of the multi-staged firing process progressing from the early stages shown in the left illustration to the final ignition in the right illustration. The Dense Firing Matrix indicated therein is a normal explosive charge with multiple points of ignition and is described below.

As shown in FIG. 1, one of the most basic forms of the current invention provides sequential ignition of multiple charges. After the first charge (top of left illustration which is labeled A at the top), each sequential subsequent charge is timed or otherwise engineered to occur just before the previous charge ceases to add acceptable velocity (and before the gasses from that previous charge begin to have trouble supporting their own expansion and start weakening the overall compression). The new charge, by separating and partially sealing itself off by an effective piston from the previous, cooling charge, provides more genuine additive velocity rather than just more burned fuel. This approach also provides that additional power without adding to the diameter of the required bore or increasing the burn distance of the energetic material which are major factors in enhanced velocity solutions. Further, the hottest portion of the overall combustive force is consistently kept closer to the ideal location, i.e. closest to the payload being accelerated. The ideal, of course, would be a rocket which continually keeps effective combustion placed closest to the payload but that less-explosive acceleration process requires too much barrel length for the velocity gain requirements of most applications. The current invention, as will be seen below, keeps combustion closer to payload without losing explosively rapid acceleration over short acceleration distances.

Note again the leftmost illustration labeled A. As the first stage is ignited, everything "below" that initial charge is moving away from the initial charge together in one piece at a conventional projectile velocity. Then the second charge is ignited (by any one of many well-known timed, fused, light-sensor based, laser-fired, trip-wire contact ignition processes, etc.) and the single remaining yet unfired load (charge), along with the projectile itself is still joined together and moving together away from the two initial charges at an increased velocity as shown in A. Finally, in the rightmost illustration in FIG. 1 labeled B at the top, the third stage is fired separating and further accelerating the projectile against the still expanding piston-driven force behind it on one side and additionally accelerating the projectile. There can, of course, be any number of stages limited only by timing constraints and barrel length.

The above piston-like isolation means and the placement of force closest to payload provides additive velocity as well as additional explosive mass in traditional bores without additional burn time and also sets the stage for additional advantageous means. One example of those additional advantages, in FIG. 2 includes embedded weights labeled "Load A" and "Load B" in this illustrated embodiment. The momentum of each weight resulting from it's significant mass and high speed, in addition to the force of the expanding gas behind it, provides a powerfully resistive platform against which subsequent ignitions can "push off" from with said resistive platform moving right along with the forward payload. The result is, in addition to the advantages in explosive physics of keeping the ignition area closest to the payload, that much more of the additional explosive is applied to additional velocity. Similar to the principle of firing a gun from a speeding train that is traveling in the same direction in which the gun is fired, the velocities are additive relative to the masses thus achieving speeds significantly in excess of those driven/limited by the burn rate of the energetic material in the cartridge.

Figure 3:
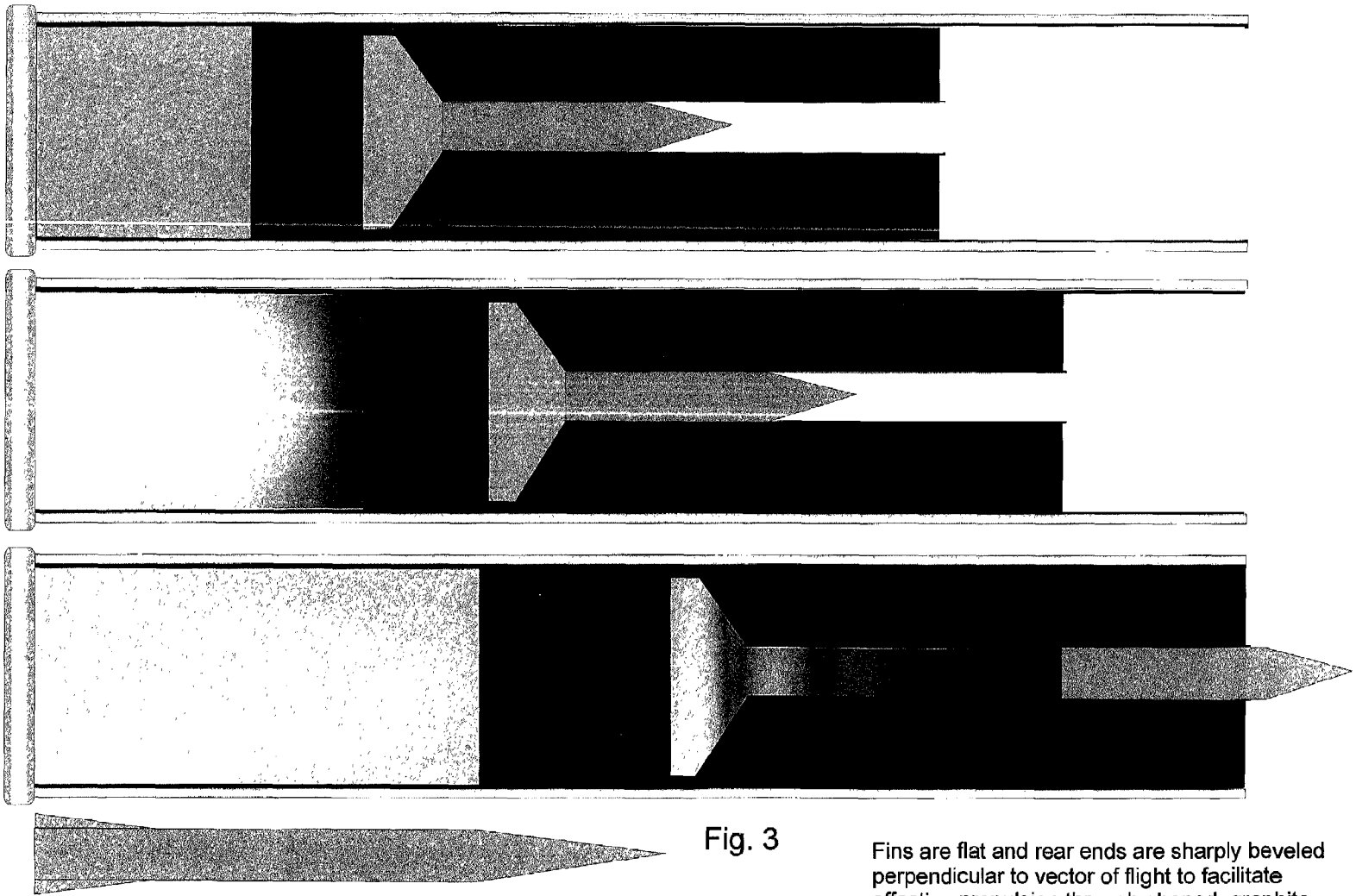
FIG. 3 applies this same idea to a Sabot like configuration with the Sabot itself used as both the weighted body and a second barrel for a sequential (second) ignition and firing through a barrel contained in the Sabot and stabilized by the barrel. It also shows an enlarged picture of the projectile with the optional fins.

Similarly, in FIG. 3, such weights can additionally or alternatively be in the form of a weighted Sabot (which, itself, can follow previous acceleration stages). As shown in FIG. 3, using a first charge capable of accelerating the combined projectile ahead of it at a fast conventional speed (say 1.2 KM/sec), the weighted Sabot carrying the smaller diameter and lighter ultimate payload achieves it's conventional velocity. When the charge inside the Sabot fires, it fires against not only the continually accelerating first stage (protected from gas mixing) but also against the inertia of the weighted Sabot already traveling at, for example, 1.2 KM/sec.

Ignoring the continued acceleration of the first charge, the gas isolation, and the combustion placement advantages of the current invention, the contributed acceleration of even a conventional charge in the Sabot separation alone provides predominantly additive velocity. This is accomplished even though the expansion rate of the energetic material is as slow or slower than the projectile it is attempting to "chase" and thus accelerate (which is why projectile speeds top out regardless of amount of explosive used—it is hard to push someone ahead of you when they are running as fast or faster than you are).

If the secure-in-barrel Sabot separation charge is only conventional (not dense matrix as described later) but adequate to propel the projectile at 1.2 KM/sec under normal solo-stage conditions and if the ratio of Sabot weight to ultimate projectile weight is, for example, 5:1, the immediate, additive velocity from the securely in-barrel Sabot separation alone is 1 KM/sec. resulting in a muzzle velocity of 2.2 KM/sec. with only 2 stages and none of the additive process described below being used. Using these elements of the current invention alone, the math is already favoring this process beyond these example numbers since the higher velocities as we approach the hypervelocity range drastically reduces the required size/weight of the resulting projectile significantly increasing the mass ratio above which increases the resulting speed (which further reduces needed mass).

This example provides a 2 stage combined velocity with ordinary conventional loads of 2.2 KM/sec. without any necessary modifications to conventional firearms to accommodate these new shells. This process applies the entire length of the barrel towards acceleration gain.

Additional intermediate stages also effectively provide additional rapid acceleration into classic hypervelocity ranges where additional and substantial performance advantages occur. The explosive acceleration against an already accelerated platform provides acceleration moment over vastly shorter distances than rockets can achieve. These shorter distances achieved by "explosive mass-push-off" acceleration rather than a rocket's continuous softer, mixed-gas push-off allows more extreme velocities to be achieved within the shell and barrel constraints of conventional arms.

Because of the substantial favor given to the swift in Physics, this allows the use of smaller, more wind-independent (more accurate) and safer ultimate projectiles (which, in turn, results in even higher velocities—which further reduces size requirements and even higher velocities, etc.—i.e. a favorable self-enhancing cycle). Smaller projectiles can be used because of the higher penetrating power and resistance to low angle deflectance associated with hypervelocity speeds. Safer projectiles can also be used because the density of depleted uranium isn't needed when velocity alone provides the needed penetrating power with less hazardous and more cost effective materials.

Improved accuracy, range and penetration using stable, in-barrel separation. Mid-air Sabot separation, while a long established process, always potentially degrades speed, range, and accuracy to some degree simply because a. The large (compared to projectile diameter) Sabot is slowed by wind head resistance outside the muzzle.
b. It is more affected by cross-winds pushing the projectile-containing Sabot slightly off course.
c. The act of separation itself can be unstable with the process occurring in a less than perfectly balanced, synchronized process—particularly when exacerbated by wind and weather conditions.
d. The separation occurs outside the solid stability of the barrel.
e. There have been observed problems documented by the military with conventional Sabots in the barrel with partial Sabot crushing caused by unbalanced forces against a structural design not adequate to thrive under the typically extreme explosive conditions which is associated with the more fragile nature of a device designed to be split apart by air.

The current invention includes means to separate the Sabot from the projectile from within the barrel or within the stabilizing force of the barrel, depending on embodiment, while eliminating crushing/malformations in the Sabot with a solid (not made to fall apart) Sabot design which additionally adds substantial velocity as a spin-off benefit to a superior separation process.

The improved, explosively separated Sabot provides a smooth, stabilized separation in the barrel. Even if the Sabot is allowed to separate after leaving the muzzle, the separation process is more stable than the fly-apart design but, with separation in the stability of the barrel, accuracy is greatly increased.

As shown in FIG. 3, the projectile, fins and all, can proceed right through the potentially solid-cast Sabot. For maximum efficiency, the fins rear edges are flat (the leading edges can, however, be canted to minimize drag create stabilizing spin and the inside track for the fins can, additionally, be placed in a slight spiral whose tangent is congruent to that of slightly curved fins. However, in the illustrated embodiment, the fin edges are canted for projectile spin at release but the tracks allowing passage through the Sabot are straight and parallel to the flight vector. This provides a unified plane efficiently responsive to the explosive separation pressure to maximize thrust applied to the projectile as it proceeds through the Sabot. The fitted slits through which the fins proceed simultaneously preserve compression while effecting rigorous stability (no unplanned twisting, turning or rocking) through the Sabot which is itself stabilized by the barrel.

Desired spin can also be acquired without canting by allowing the Sabot to spin by conventional barrel rifling which, in turn, provides rotational inertia to the projectile. This can be used to provide additive spin to projectiles with canted fins and/or be used to provide stabilizing spin to projectiles with un-canted fins or to projectiles without any fins at all.

Figure 4A:
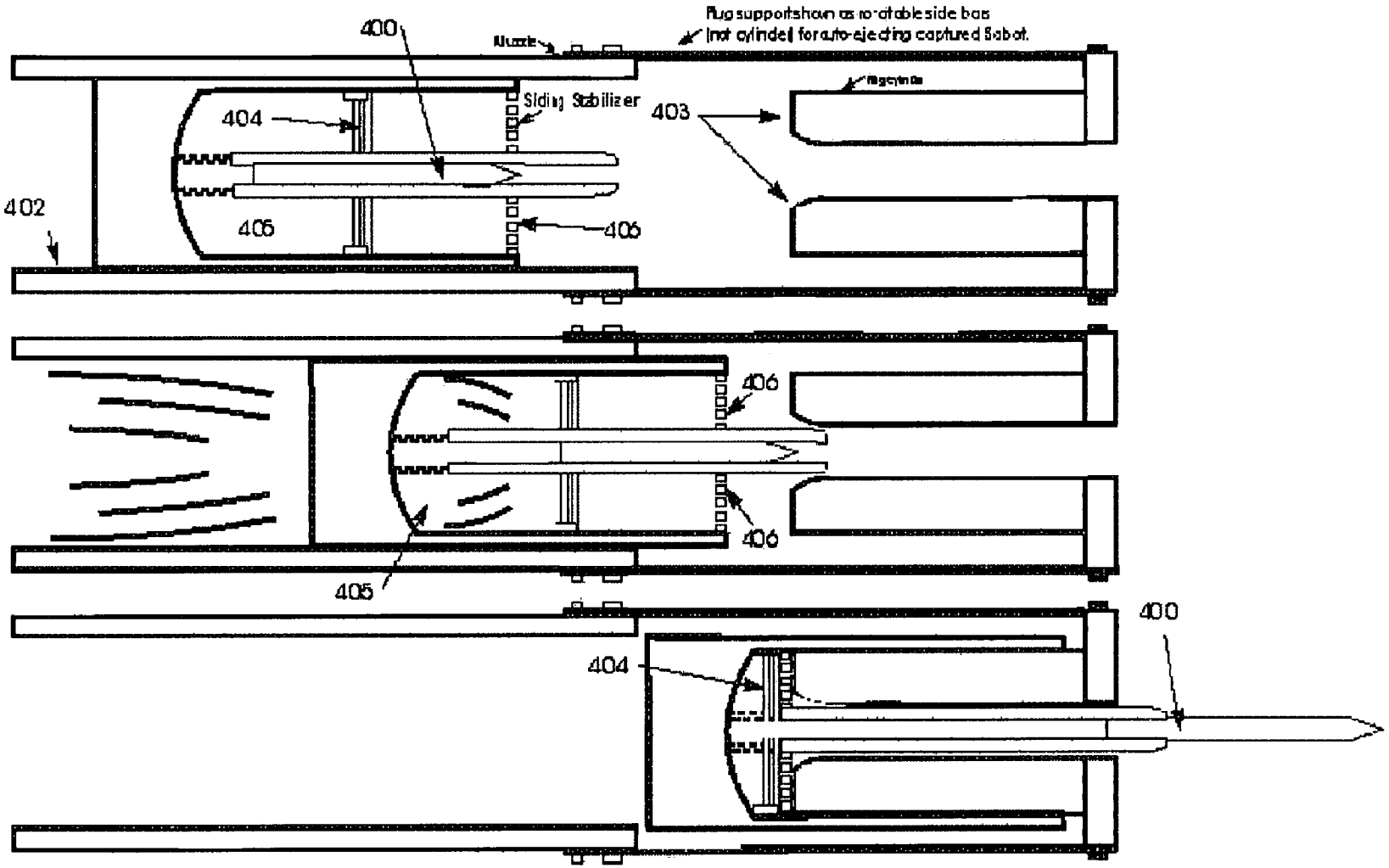
FIG. 4A illustrates the process of favorably leveraged conversion of final momentum at exit to additional velocity as the modified Sabot, 401, traveling in barrel, 402, collides with a fixed plug, 403, at the end of the muzzle forcing the diaphragm, 404, to move left thus compressing the fluid/gas/etc., 405, in the chamber to the left resulting in pressure adding further velocity to the projectile, 400.

Sabot capture for safety and additional speed. There is also the potential for fired Sabots injuring field personnel. In FIG. 4A, an externally captured Sabot process particularly applicable to full barrel length applications not only eliminates this problem by containing the Sabot (automatic ejection option described below) but also, because of the unique cavity design in the Sabot applied to hydraulics, converts the otherwise wasted kinetic energy of the high-speed Sabot's momentum, the internally still captured gas pressure preceding the Sabot, and all, if any, previous weighted and fast moving stages into still more explosively additive acceleration for the projectile at the last instant. One of many approaches to subsequent high-speed Sabot discardation is illustrated in FIG. 4E.

As shown, an in the top frame of FIG. 4A, an already fired-into-motion stage carries another charge ahead (to the right) of it. Somewhere towards the end of the barrel but prior to exiting (timed with fuzed, synchronized electronic or other ignition), this additional in-Sabot charge fires against the weighted, high-velocity chamber in which it rides (and against the forces of preceding stages) providing strongly additive velocity to the projectile as described above. It should be noted that the moveable diaphragm can move only to the left due to, in the illustrated embodiment, the diaphragm riding in slits (not shown) in the Sabot wall which do not extend to the right but only allow travel to the left. This prevents the diaphragm from moving to the right when the Sabot contained charge ignites, thus applying the explosive to additive projectile velocity, while allowing it to move to the left when it encounters the plug to the right additively providing high-speed re-compression of the still exploding gas that is accelerating the projectile. These slits are not required for impact-created ignitions described below since the engaged plug itself prevents rightward motion of the diaphragm. Still more additive velocity could be gained if we could somehow capture and add all the kinetic energy of the preceding weighted stage(s) and the Sabot itself explosively to the end-projectile velocity in an instantaneous conversion from wasted energy to explosively released all-additive acceleration. Even further improvements would be effected if this could somehow hasten the rate of combustion to make the Sabot-contained explosive itself provide higher-speed acceleration than in conventional explosive ignition. While the velocity-weighted hydraulic mechanical advantage/ratio of the Sabot's diaphragm diameter to the projectile's diameter leverages/multiplies the end velocity hydraulically whether the liquid/gel in the cavity explodes or not and while this non-explosive content option is a valid embodiment of the current invention, the drawings illustrate an energetic material to the left of the diaphragm.

All of this is accomplished in the current invention as the previous stages moving at very high speeds slam into a firmly fixed plug (contact shown in FIG. 4A, frame 3 at the bottom) against the already expanding combustion pressure of the final charge within the Sabot. (As shown, the exceptionally square-wave immediacy of this explosive addition to the forces already propelling the projectile as the energy is completely converted in microseconds upon impact, provides an immediate moment not limited by the burn speed of energetic material and is thus completely independent of known explosive "top-out" ranges. Here we have an explosion in progress at its conventional maximum rate but under tremendous, instantaneous compression of these oxidizing gasses which provides several additional catalytic improvements.

a. The compression itself speeds up the speed of energetic material oxidation since increased pressure reduces the time required for oxidation and
b. The instantaneous compression also creates great heat added to the already hot burning gasses instantly upon impact further accelerating the rate of combustion and thus the amount of genuine acceleration over time (accelerated rate of combustion thus greater acceleration from the same combustion).
c. The sudden propelling compression of the impact itself as directly applied to the direct hydraulic acceleration of the projectile adds velocity.
d. When the speed of impact exceeds the detonation rate of the energetic material (which is particularly common with either multiple stages or safer explosives), the detonation wave from the impact is actually faster than the wave caused by the original, conventional detonation. Further, the detonation will typically be coming from the end opposite the non-impact detonation such that the two waves will meet somewhere in the middle (but taking less than ½ the time the normal detonation would have taken) rather than waiting for one wave to go the entire distance thus further increasing the rate of acceleration applied directly and additionally to the projectile.

The free-sliding stabilizer is optional but provides, in addition to more stability, a non-abrasive, sacrificial layer softer than the material of the plug so that the plug is not damaged even in multiple firings.

There are numerous means in the current invention provided to the implementing engineer to fine-tune the "squareness" of the impact wave. Obviously, such an impact at such a high speed, when un-damped, provides a remarkably square wave resulting in extremely rapid redirection of energy ideal for the rapid addition of acceleration to the projectile. However, the more immediate the energy transfer, the more containment strength required by the containing media. In this case, if, for example, these new munitions were to be used in a conventional cannon or firearm already in use in the field and built to low containment standards, the implementing engineer has numerous means to adapt the munitions to the existing equipment.

The next is the explosive itself. If the explosive in the Sabot is a liquid explosive, a very square wave will result. However, if the explosive is a gas or bloated-content gel (optionally in a flexible, chamber fitting, thin plastic containment for long-term storage), for example or an explosive that rapidly converts to gas prior to impact, the gas itself damps the square wave of the impact by absorbing the immediate energy as compression.

A second is the sliding stabilizer so labeled in FIG. 4A (just to the right of the diaphragm). This stabilizer, when meeting the plug (shown at the far right), slides towards the diaphragm. The stabilizer can be constructed of impact dampening (compressible) materials. Also, a sealed stabilizer turns the area to its left into a shock absorber. Further, "holes" can be placed in the sliding stabilizer, illustrated here as a non-solid line. With the squareness of the initial impact (before the stabilizer reaches the leftmost point of travel) being inversely proportional to the diameter of the holes, pressure will form in advance of the diaphragm adding pressure to the combustion/acceleration area but at a compression damped rate that will smooth the squareness of the wave. Other damping means are described separately below.

Figure 4B:
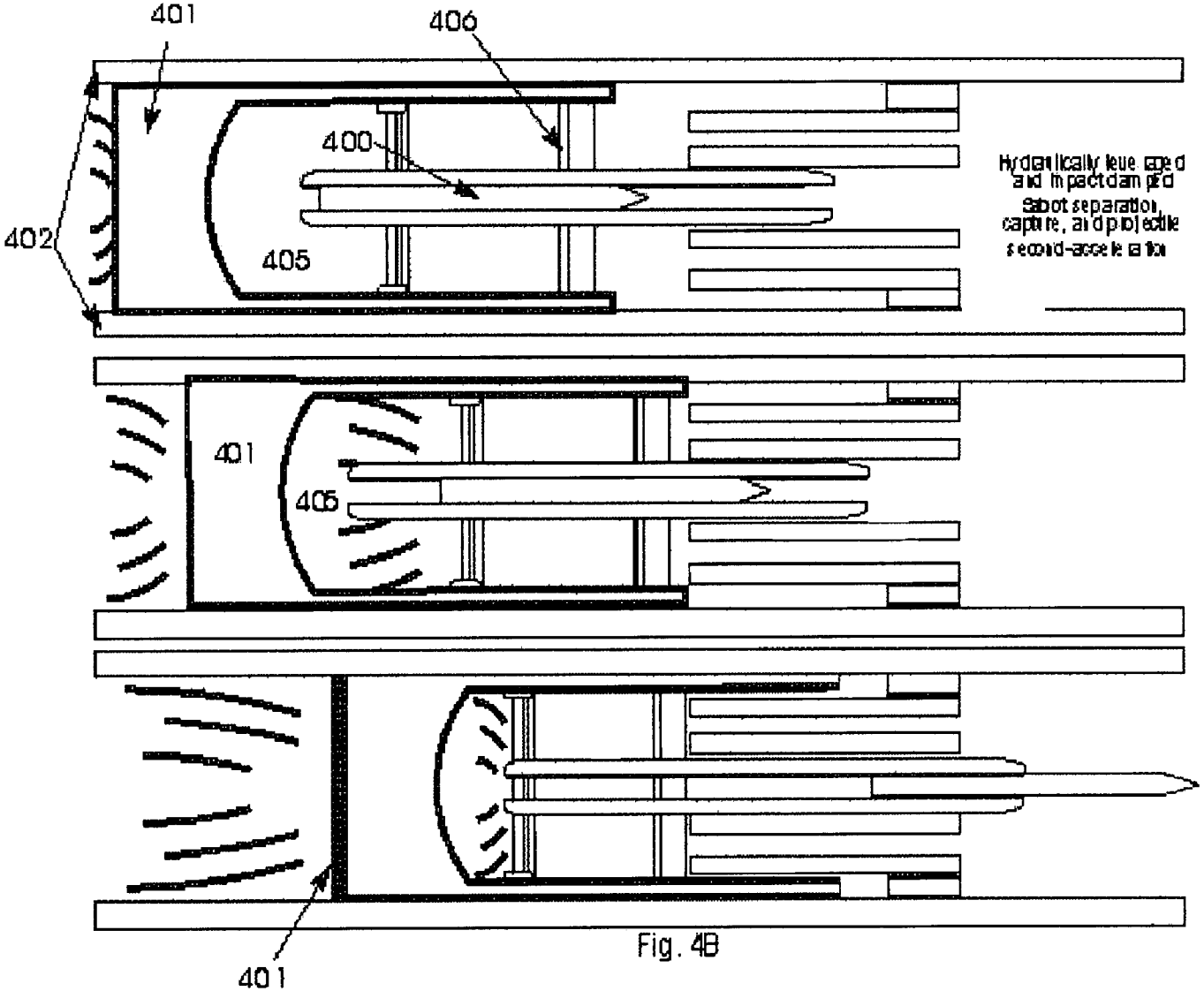
FIG. 4B closes or reduces the size of the holes in the sliding stabilizer, 406, to create a shock absorber between the compression chamber and the impact to allow easy control of damping where necessary.

FIG. 4B illustrates yet another damping tool and a process similar to that in FIG. 4A except that a captured layer of gas or normal air is located between the plug and the final explosive charge area providing even more stress and impact control than the hydraulics above alone. The Sliding Stabilizer of FIG. 4A has been replaced by a compression cylinder with no "holes" to limit compression as it is forced to the left. When the Sabot impacts the plug, its first contact is made with this gas compression cylinder or piston which moves freely (leftward), under the influence of the impacted plug, compressing the gas between the compression piston and the final charge area. This applies an impact-damped compression of the already exploding gasses in the final charge area. The same hydraulic and combustion acceleration advantages and fine-tuning-to-application means apply to this damped version resulting in instantaneous conversion of otherwise wasted early stage and Sabot kinetics to additive projectile velocity.

Automatic Sabot Ejection/Disposal. The Sabot capturing plug can, by obvious mechanical means, be rotated or otherwise moved or destroyed by powered means (including recoil or effluent driven ejection common to automatic weapons) and the captured Sabot harmlessly discarded. As shown in FIG. 4E, the plug can be spring loaded to further dampen the square wave as desired. The plug can rotate out of the way or otherwise reposition back for the next use, if it has moved in the discarding process chosen, and lock into position for the next shot or it can be left out of the way to accommodate conventional (non-Sabot loaded) shells. FIG. 4E illustrates a general embodiment of a high-speed automatic Sabot ejector that uses the spring loaded power of impact to, when the forward motion is fully dissipated and the spring thus begins to reverse the motion of the Sabot, also rotate the plug as the Sabot ejects from the plug and then either continue it's rotation to or reverse back to the fire-ready position for the next shot with speed comparable to the reloading cycle of a semi-automatic. "Latches" like the one shown in FIG. 4D optionally serve to assure that the ejection assembly and Sabot are independent of (not hindered by) the barrel.

Figure 4C:
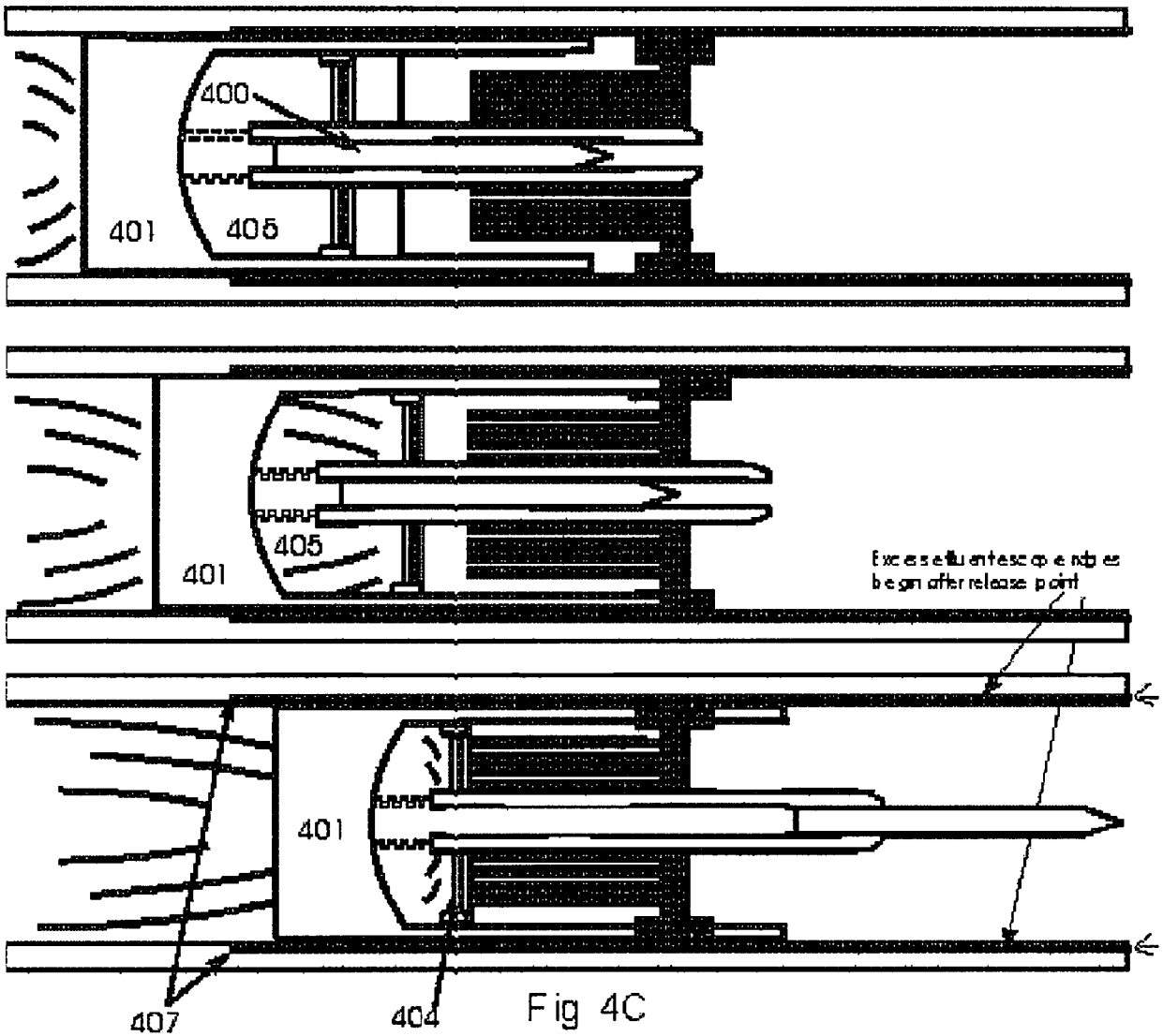
FIG. 4C illustrates a modified assembly accommodating the elimination of the sliding stabilizer and illustrates the optional in-barrel excess effluent escape channels, 407.
Figure 4D:
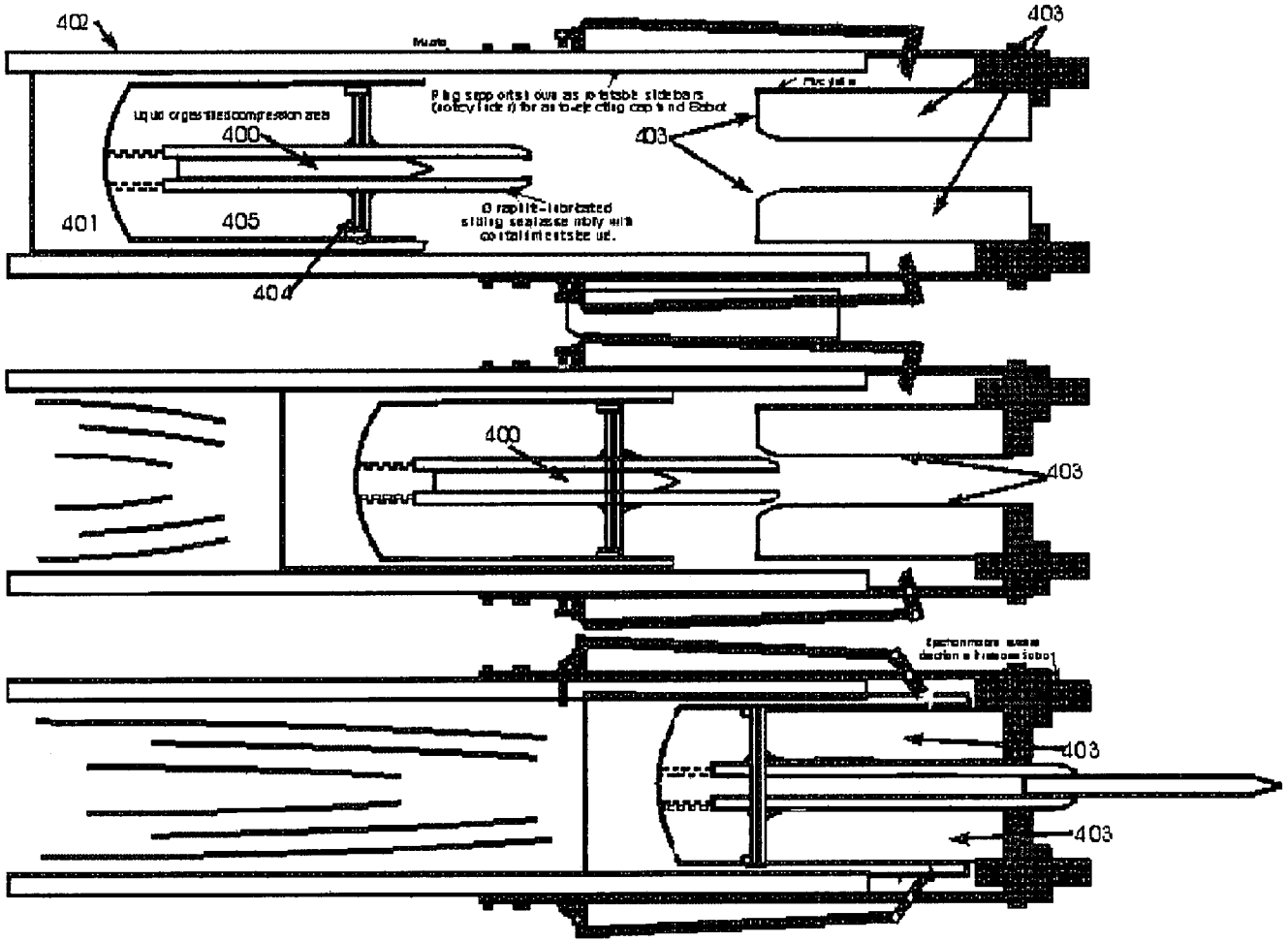
FIG. 4D additionally illustrates an assembly to prevent the recoil of the Sabot back into the barrel to support any form of later ejection means.
Figure 4E:
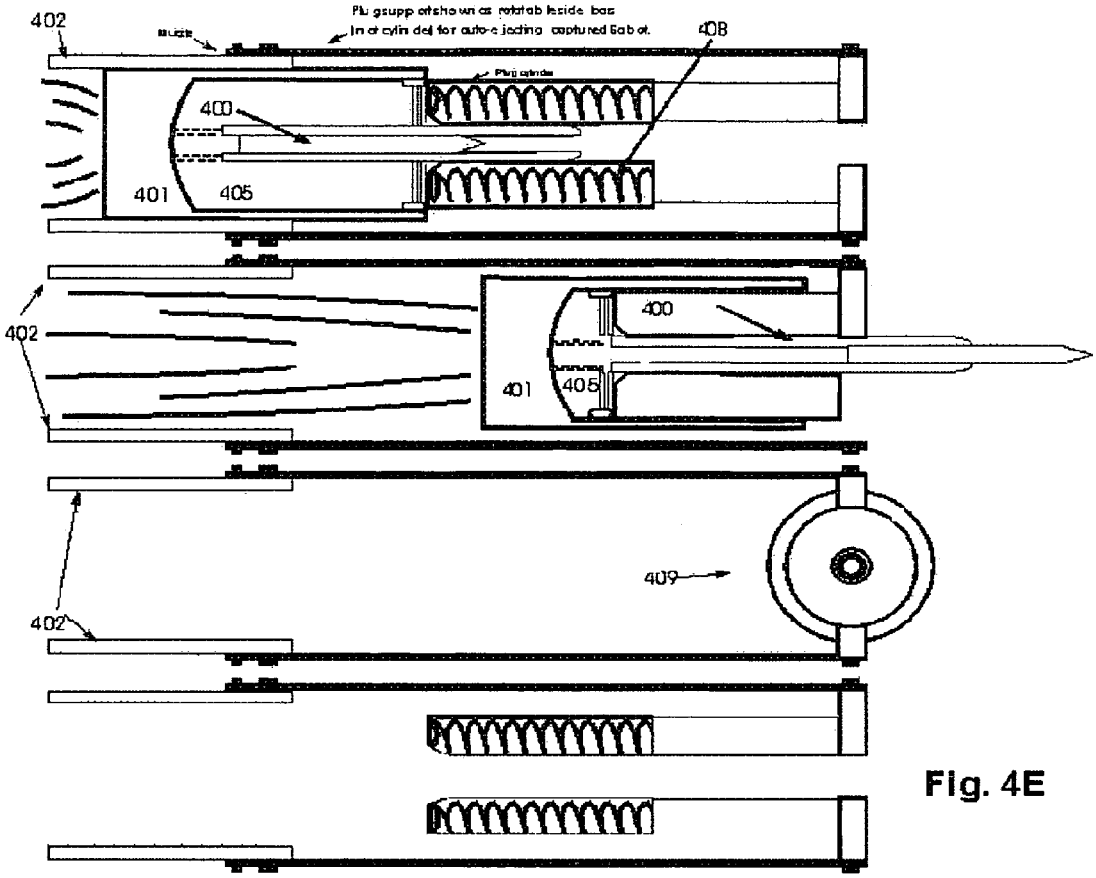
FIG. 4E illustrates one simple embodiment of an ejection means showing an optionally spring-loaded plug, 408, both for damping and to provide power for the subsequent rotation, 409, of the plug with captured Sabot.

Safety release of excess trapped effluent by previous stages can be achieved by multiple means including release grooves in the inside of the casing as shown in FIGS. 4B and 4C. The grooves, exiting gasses to the right (in the direction of the projectile) begin at a point to the right such that the stage has effectively done it's work before it's excess gasses are released. Even then, only amounts required to provide safety within the containment strength of the equipment will be released since all thrust forward, even from the beginning, is beneficial. Other release mechanisms, such as the impact puncture of the pressure differential separating medium in the outside cylinder of the vacuum creation illustration in FIG. 7A just as soon as forward motion has reached the point where its work is done, vent excess pressure forward. All excess effluent is released safely and only after all the work is done in the embodiment shown in FIG. 4D when the Sabot has actually left the barrel (still contained by the ejection assembly) and effluent can now escape out the muzzle. These are obvious and intended only to provide release of excess, unneeded effluent for safety.

Hydraulic mechanical advantage and other advantages. This hydraulic pressure can be adjusted for leveraged gain by adjusting the relative diameter relationship between the charge area/diaphragm and the projectile. The larger that charge/diaphragm diameter, (here the final charge area is shown as taking up the entire available diameter in the barrel) compared to the diameter of the projectile, the lower the pressure added upon impact (in PSI), the softer (greater) the damping effect on the fast moving Sabot (minimizing plug and barrel strength requirements), and the faster a larger volume of gas attempts to accelerate the projectile.

By reducing the diameter of the impact diaphragm relative to the diameter of the projectile, you can create a substantially higher, hydraulically leveraged pressure (more PSI) upon impact to be applied instantaneously against the projectile. This allows the manufacturer to fine-tune the hydraulic advantage to the equipment sturdiness, projectile relative weight and firing test data to maximize actual velocity to accommodate complex applications in the field. Using hydraulic mechanical advantage to create more pressure or volume against the projectile allows this feature of the current invention to further increase velocity beyond the calculations above while controlling metal stress.

By increasing the ratio of the diaphragm to the diameter of the projectile, the projectile end-velocity potential is increased. This overpowers the problem of the projectile running away from the accelerating gas by literally multiplying the speed of the accelerating gas.

Completely self-contained Sabot Capture Applications: It should be noted in FIG. 4B that the plug, shown earlier in FIG. 4A, has been moved from the end of the barrel to the outermost portion of the inside of the cartridge to illustrate this optional placement. FIG. 4C illustrates plug applications without the extra gas compression stage. Obviously it works either way. This allows Sabot capture and higher velocity without barrel wear (since the projectile never touches the barrel) with 100% unmodified firearms which, obviously, is most applicable to short barrel (including hand-held arms) applications where great velocity is desired and long barrels are not present anyway. This does, however, create tighter timing problems because of the much shorter distances of transition which timing problems are dealt with below. However, timing considerations and solutions vary with the design of the firearm and one solution can't necessarily apply to every application.

Non-Timing-Required, Non-secondary Explosive Required Accelerator. The current invention additionally provides an optional, non-timed and even optionally non-explosive means to separate and accelerate the final stage of the projectile while damping internal stage impact stress, converting their velocity to additive projectile velocity, increasing accuracy, and safely capturing the Sabot. With an assembly like the one shown in FIG. 4D, the final charge area can optionally be filled with a gas, gasses, a stabilized gel or liquid. For example, the cavity enclosed by the final charge area (titled for that figure's illustrated embodiment "Liquid or gas filled compression area") can be filled with a liquid, gas or gel (which may be stored in the cavity within a sealed, shaped or shaped-by-the-encapsulating-cavity film for stability and long term storage under harsh environments).

By eliminating the final explosive charge in this area, we eliminate a timing requirement and broaden the applicability of the process to more applications without firing mechanism modification to existing equipment in the field. Yet, when the Sabot impacts the plug, the projectile, which is already itself traveling at high speed is substantially and additionally accelerated solely by hydraulic forces even when there is no explosive charge. The barrel end plug can be extended to allow room for more stages so earlier intermediate stage(s), not shown, can combine to bring it to this point.

When an explosive charge is not used in the final charge area of the Sabot, a new problem exists that is solved by the unique design of this area of the current invention. The same problem, dealt with above related to multiple stages, etc., is that it is hard to push something that is moving as fast as you are. This is additionally overcome by the strengths of the hydraulic design of this area of the current invention. If, for example, there were no mechanical advantage possible and for every inch that the diaphragm compresses the final charge area the gas or fluid propelling the projectile moved exactly 1 inch, no significant additional acceleration would occur. That is because, just prior to impact, the Sabot and the projectile it carries are both moving at the same speed, for example 3 KM/sec. due to previous stages. At impact, the projectile continues its rate of travel being effectively unattached to the Sabot although a negligible and minimal anchoring (certainly negligible for a heavy projectile moving 3 KM/sec.) stabilizes the projectile in the Sabot for shipping and handling. If the plug completely applies all the velocity of the Sabot in un-leveraged form to move the projectile at the speed of the Sabot from which that speed of motion came, it would be effectively the same speed at which the projectile is already retreating from the rapidly slowing and soon-to-be motionless Sabot. While it should be noted that the forces behind the Sabot including the initial ignition and any intermediate stages would contribute additional acceleration, much of the Sabot's momentum would be wasted rather than applied instantly to additional velocity. Another advantage of the leveraged options is in the control of recoil. By extending the acceleration over multiple stages (rather than a single square-wave big band) and then fine turning "squareness" of the final stage, recoil can be better controlled for the safety of the user and the accuracy of the firearm.

Thus, the current invention provides means to hydraulically ensure that:

1. There is adequate impact damping to prevent shearing or crushing
2. The vast majority of the kinetic energy of the Sabot and preceding explosive forces and weights are converted and applied to additive velocity and
3. Recoil is better controlled.

If, for example, the diaphragm that impacts the plug has a diameter of 4.72" and the diameter of the projectile is 1" then the mechanical advantage (measured as the ratio of the area) is approximately 1:20. In other words the fluid or gas in the chamber will attempt to move (push) the projectile through the inner barrel 20 times faster than the projectile it attempts to push is moving. Great adjustments to unique hardware and specific applications can be made by varying these hydraulically driven power versus speed decisions by simply varying this area ratio. Thus, beyond friction, roughly 19/20 or 95% of the impact from the collision of the Sabot with the plug will be redirected to even further projectile acceleration rather than being "outrun" by a projectile already moving at the same high-speed as the container that attempts to propel it further with its own kinetic energy.

Non-Timing-Required Sabot Accelerator with Separation Explosion:

It is also possible to have an explosive charge in the Sabot that requires no ignition process and thus no timing mechanism. The final charge/compression area described just above can also be filled with an explosive yet hydraulic material (perhaps something similar to clear liquid Astrolite A-1-5 in extra stabilized mix or liquid Astrolite G with a detonation velocity of 8,600 meters/sec. with extra gel stabilization or any semi-liquid, gel, slurry, etc. that has appropriate detonation initiation and detonation rates), which, while still hydraulically converting the otherwise wasted kinetic energy of the heavy Sabot (and the partially spent gasses and earlier accelerator weights from previous stages) detonates with impact induced density and compression-heat-enhanced detonation speed into projectile additive acceleration upon impact with the plug to provide additional yet timer independent acceleration. To fine tune the current invention to specific sensitivity to initiation for a given explosive, the rate of the shock wave as applied against the rear of the projectile can be fine-tuned for maximum efficiency by choosing the most favorable hydraulic mechanical advantage as explained above. While flexibly sealed (such as in a thermoplastic binder or softer sealed plastic shaped and supported by the walls of the final charge area), explosive gasses, fluids, gels and stabilized slurries, etc. can, though already in the immediate natural process of hydraulically accelerating the projectile at impact, self-detonate from the leveraged, high-speed impact throughout the medium. This can be faster detonation than the unleveraged, conventional but sometimes slower cap detonation shockwaves or end-to-end powder burns that limit speed of acceleration. Thus, even when the explosive is "toned down" for Insensitive Munitions user safety, hydraulic leverage can be used to tone down or up the squareness of the wave to not only create the ignition at the precise moment of impact with no ignition timing mechanisms but to create an ignition wave that is faster than the safer explosive's ignition rate. Thus, more acceleration can be obtained from the same explosive by creating an ignition wave from impact that exceeds the detonation rate native to the explosive as conventionally detonated.

This provides a multi-stage process functional in limited space with no timing requirements for those applications where that is advantageous. Alternatively, the Sabot stage just described can simply replace the Sabot of a conventional shell (no intermediate stages). The projectile itself never slows down being effectively free to continue its high speed trip unhindered even as the plug impacts the containing Sabot and begins instantaneously (no delay at all particularly for liquid or gel based explosive hydraulics) to transmit additional acceleration to it.

Another profitable process involves a conventional impact cap (for example on the diaphragm adding functionality to the plug as a firing pin) initiating ignition upon impact with the plug which can also be useful for producing an untimed detonation whose detonation rate is enhanced by the pressure and heat of compression of the same impact that further hydraulically propels the projectile for a more powerful detonation shock wave. Thus, the addition of a conventional firing cap paired with the shock wave and accelerated combustion discussed earlier allows the substantially enhanced acceleration performance of a much safer charge.

Additional increases in velocity, along with added firing reliability are accomplished in the current invention with the addition of means to burn conventional energetic materials more efficiently, quickly and completely. This also provides the expansion in the time window in which the energetic material has the most impact on the projectile's velocity rather than wasting that combustion in a period long after the projectile has left the primary explosive area of influence.

Figure 5:
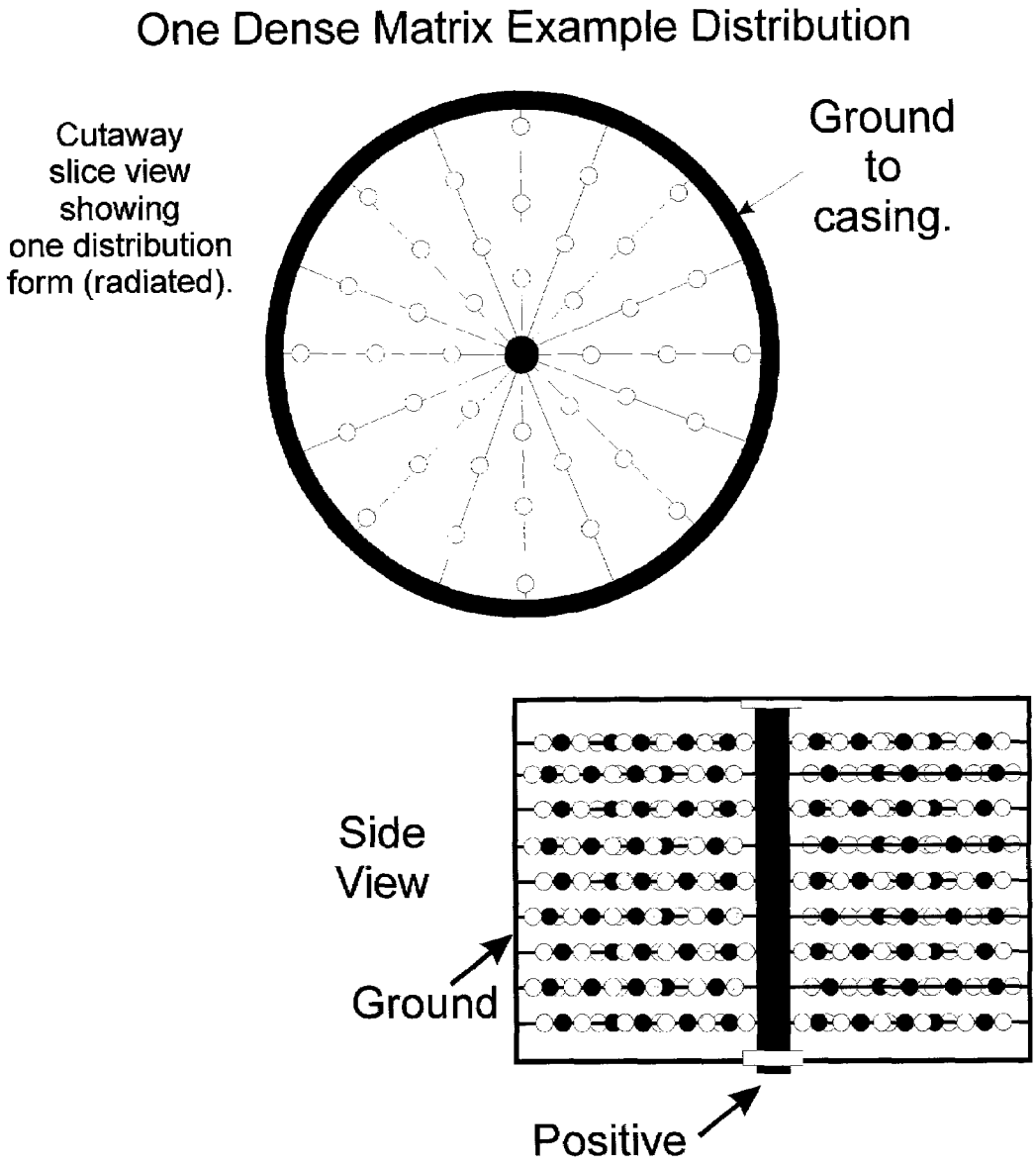
FIG. 5 illustrates, at the top, a cross-section of an explosive charge revealing one array (here a star array) of multiple ignition points. At the bottom it illustrates a side view of one embodiment pointing out a singular positive charge entry point for all positive entries and the casing itself, in this embodiment, as the singular contact for all negative entries.

Traditionally, charges burn end to end, i.e. from prime material at a singular point through the full width and depth of the secondary explosive until it's all burned. Unfortunately, by the time the last of it burns, the projectile is not longer under the full or even substantial effect of the gas and thus explosive is wasted and potential velocity unachieved. Further, since so much of the explosive burned sequentially instead of simultaneously, velocity was fixed-ceiling-limited as a product of the material's detonation rate. The current invention provides means to provide substantially increased speed of detonation by igniting the secondary explosives from multiple points simultaneously in a rapid oxidation matrix rather than a single prime point followed by end-to-end detonation. Some of the means applicable to the current invention are:

1. Multiple rim fire. The simplest example only ignites the rearmost plane of the charge but it does so from multiple points on that plane (optionally including center fire). Thus the process is accelerated. Here, the firing mechanism, instead of igniting a single point associated with prime material, ignites several at the same time. For example, a ring of 5 firing points impacting equidistant points along the circumference of the rim plus one or more points inside that perimeter including the center can reduce the burn time to under 20% of normal with predictable increases in acceleration.
2. 3-D Oxidation matrix of bridgewires. Illustrated in FIG. 1 and in more detail in FIG. 5. Using multiple simultaneously switched bridgewires or other point or area ignition devices each connected to 1 or more prime material granules or patterns of shared wires (such as the radiating wires from the central positive charge-fired hub shown in the FIG. 5 example) applied evenly distributed in the secondary explosive, the entire "neural" matrix is ignited simultaneously. This cuts the burn time to the product of the secondary element detonation rate and the very small average distance between each neuron/granule of prime material.

3. 3-D Oxidation prime cluster. Here multiple prime material clusters evenly distributed throughout the secondary explosive are simultaneously ignited by strong electrical, high-energy photon (ex: laser) or other directable, distributable ignition force. An example is a high energy electric current flowing evenly distributed through the oxidation matrix from an even number of multiple, separated plates making up the circumference of the shell tube making operative contact with electronic charges whether direct or capacitive with opposite charges at the diagonals, opposite charges between adjoining plates or both in a rapidly oscillating cycle. Another example uses high-energy photon or other directable, distributable ignition force to simultaneously detonate multiple, spaced primes simultaneously by bombarding the entire area or a dense array of points in the energetic material.
4. An all secondary explosive or primary/secondary mixture to be ignited by very high energy means, as above, uniformly throughout the matrix points as above. In the case of the all secondary explosive, the potentially slower deflagrating stage can be eliminated.

Vacuum Enhanced Acceleration: One of the applications for extremely high velocity projectiles, in addition to ground munitions, is the area of bombs and missiles. For the purposes of penetration, great velocity is desired. Unfortunately, wind resistance and air drag make it difficult for such large bodies to maintain such velocity. Thus it is also a stated object of this invention to allow an air to ground missile, for example, to achieve its current maximum speed right up unto the point of contact and then, with the extremely high and immediate gain of velocity associated with the current invention (by firing, just prior to impact, another stage against the existing weight and velocity of the bomb or missile), increase the projectile velocity This allows the velocity to be multiplied without wind resistance having time to slow it down or heat buildup degrading the stability of the payload providing substantial increases in penetrating power and brissance.

Figure 6:
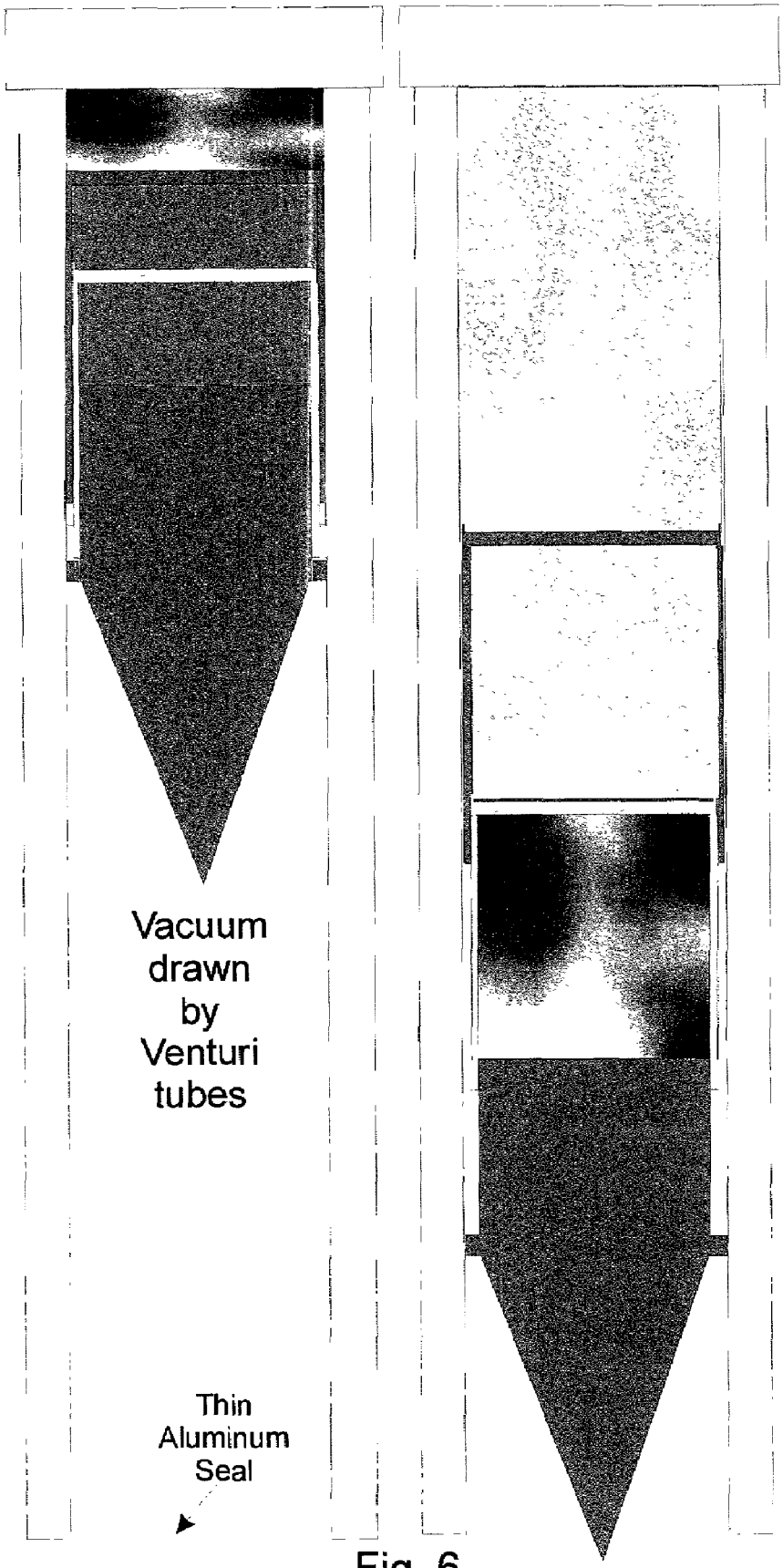
FIG. 6 adds to the configuration of FIG. 1 a vacuum drawn in advance of the projectile by the Venturi principle. The length of the barrel between the projectile tip and muzzle was greatly compressed to fit on paper.

However, the time the projectile is most sensitive to wind resistance is when it is trying to achieve hypervelocity. To reduce resistance in these early stages of acceleration, a partial vacuum is created in advance of the projectile. One vacuum creation means applicable to the current invention is the addition of Venturi tubes and spoilers (one example is shown in FIG. 6) draw a partial vacuum as air passes by at extremely high speed.

Figure 7A:
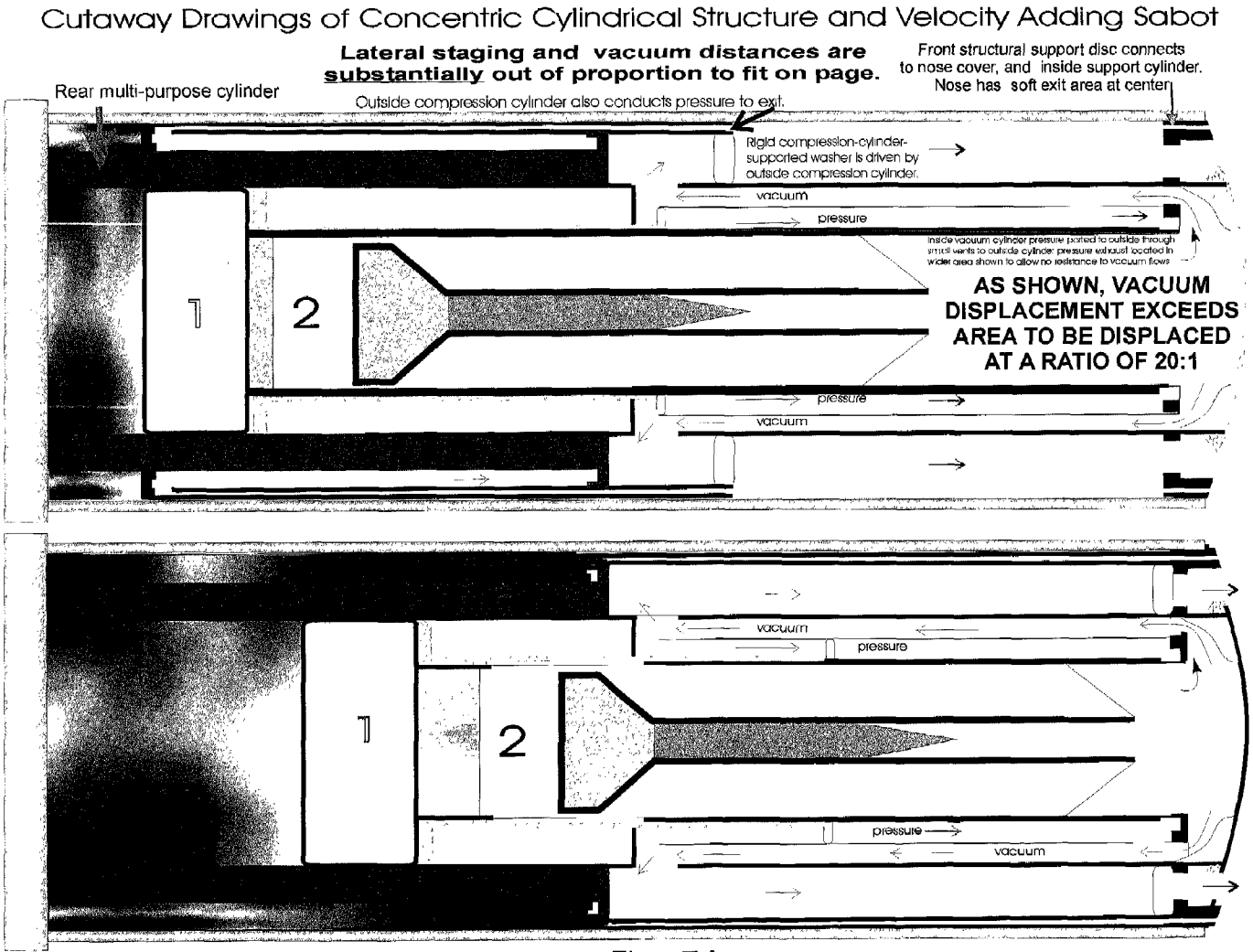
FIG. 7A illustrates a means of drawing a vacuum in advance of the assembly of FIG. 3 using, here, hollow cylindrical pistons (pressure rings) pushed by the explosives which, in turn, push a second hollow cylindrical piston through a second chamber to draw a vacuum which leads to the area in advance of the projectile to increase acceleration. Obviously, the artist has, again, greatly reduced the optional length of the vacuum path to fit the drawing on the page.
Figure 7B:
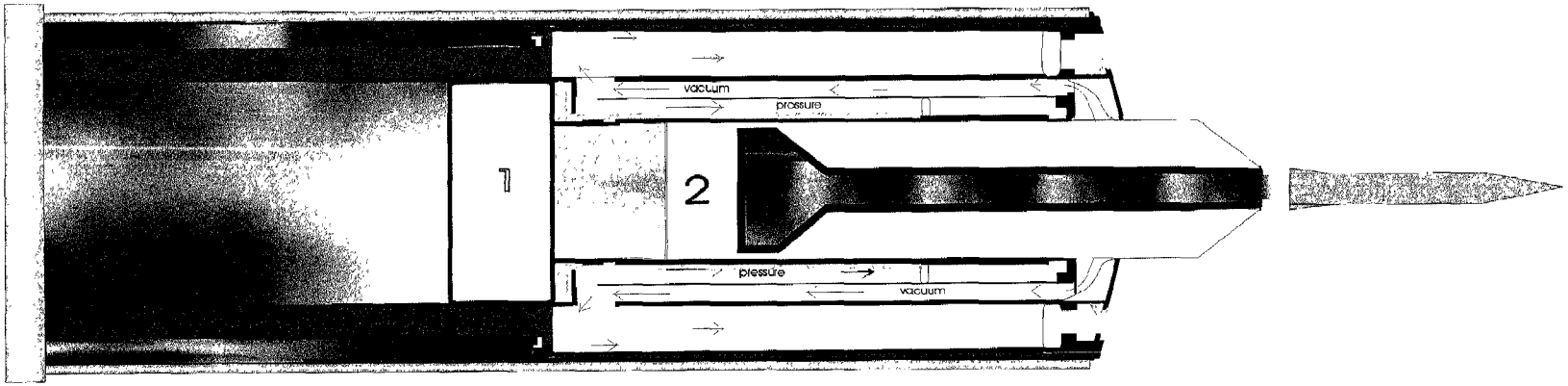
FIG. 7B completes the sequence begun on FIG. 7A.

Other vacuum creation means: There are also, in addition to common conventional means of drawing a vacuum in an area, ignition induced vacuums where the same charge that propels the projectile can create the vacuum that enhances its own acceleration. Using the primary (and/or other stage) explosive itself and/or special charges specifically for the creation of a vacuum, a rapid, fused (timed) vacuum is created in advance of the projectile. One such means is illustrated in FIGS. 7A and B. In this example embodiment, the primary charge itself (optionally enhanced by additional explosive material around the rim in the outermost cylindrical expansion cavity) propels a sealed ring, located in a cavity at the outermost radium of the casing, forward (to the right i.e. in the direction of the trajectory). As the ring seal (which may also be split into smaller linked portions such as quadrants or even be replaced by a series of individual cylindrical pumps filling the cavity) moves forward, the cylinder to which the vacuum drawing ring is attached (as drawn here) or other connective means move the seals(s) forward thus drawing a vacuum as they advance. As shown in FIGS. 7A and B, this drawn vacuum is routed in advance of the projectile.

The more vacuum desired, the more area is dedicated by individual applications to this displacement and the more charge placed at the disposal of the vacuum creation means which can include substantial amounts of charge in the sides.

When additional vacuum creation energetic materials are stored like overflow explosives in the outside rim or elsewhere, the initial charge ignition can optionally be begun at some point in these side located charges by electronic, high-energy photon, etc. to create an additional fusing means to more perfectly time the vacuum creation to the projectile's progress. This separately activated charge can burn through to the main charge normally or the main charge can be separately ignited. This makes it possible to precede any motion of the projectile with a drawn vacuum to remove air resistance to acceleration followed by later stage additional vacuum drawn during subsequent stages or as the initial stage continues.

Because of the speed and violence of the process, the seals draw a very hard vacuum which can be synchronized with the explosive dispatching of the projectile. A variety of ignition means, including impact, electronic ignition, high-energy photon and other means of energy or vibration based ignition, are applicable means to selectively ignite different portions of the load to fuse/time the vacuum creation process.

There are numerous applicable conventional means of achieving a vacuum including pumps, cold roughing systems, etc. Any vacuum drawn is contained by a thin seal (normally concave outward to provide maximum resistance to atmospheric pressure pressing in and minimum resistance to the projectile exiting) penetrated by the sharp projectile just as the projectile exits. Any vacuum creation systems that can be effectively activated in the narrow timing window necessary to create an advance vacuum without drawing away stored oxygen in and around the energetic material are applicable to the current invention. The application of these external vacuum sources can also be timed by well known light-interruption, electrical sensing or other means opening a gate to the chamber to be evacuated based on the progress of the projectile or other timing means. Naturally, the longer the acceleration-under-vacuum area provided by the particular application is, the more effective this design will be.

For a fast-moving projectile providing fast evacuation of the inside barrel, this allows hypervelocity speeds to be achieved in a protected, very low resistance environment. By the time the projectile penetrates the final thin seal, the maximum velocity has already been achieved.

It should be noted that the length of the acceleration range inside the tube as shown in the examples is greatly compressed to show detail on a sheet of paper. In practice, much more length may be used providing an extended interval of acceleration under low-pressure conditions.

Because, at release to the atmosphere, great velocity is already accomplished, the shape of a small portion of the projectile tip can be flattened at the very tip creating, in response to the high rate of speed, a partial vacuum around the projectile (similar to supercavitation in water) thus reducing air drag which increases range even more while allowing the velocity to be maintained longer. Fins, in this embodiment, extending only slightly behind this low pressure plume, provide stability.

Also, the velocity and tip shape combined also provide a powerful air to water approach to water penetration. Here, spin may be chosen to replace fins or minimize their size for stability. When the projectile enters the water, the tip, with the help of hypervelocity (which allows a much smaller flattened tip contact area i.e. much less tip resistance than with conventional supercavitation bullets) creates a powerful super-cavitation effect in water harnessing the extreme velocity with reduced drag to produce deep water bullets with more range and penetration power as well as brissance upon contact.

Another applicable area as applied to water penetration is the further increasing of the Reynolds number for deeper penetrations with deflagrating or igniter-composite pre-projectiles to reduce μ (the viscosity/denominator in the Reynolds number calculation) thus increasing the Reynolds number by lowering μ. Applicable examples of materials for pre-projectiles to be placed in front of or act as deep coatings over primary projectiles are magnesium, MAG-TEF (Magnesium/Teflon), and MTV (Magnesium/Teflon/Viton). The effects of the combustion that provides the heat provide additional drag reduction in the form of the gas bubbles it creates.

There are also some conditions under which latter stages of multi-stage ignitions could reverse the direction of earlier stages. This is typically not the case. In fact, all stages typically continue forward even when later stages push back against them explosively. However, under some optional conditions of early effluent release and/or successively and substantially higher charges with each successive stage potentially accompanied by substantially more mass in advance of the charge than behind it, reverse direction of a stage is theoretically possible and even an optional means for containment of weights or even Sabot's within the shell, etc.

Except in those unusual design applications where it is advantageous to create that rearward motion, there is a need to prevent that rearward motion. Thus the current invention provides optional locking means for these conditions to eliminate backwards travel of the second and subsequent cartridge shells. It is true that the expanding gases behind the cartridge will oppose rearward motion of the second and subsequent stage cartridges (especially since the cartridge itself provides a seal which also prevents mixing of the cooler and hotter gases) but to assure that none of the power of the second and subsequent charges is wasted on backward travel of the cartridge and recompression of cooling gasses that we have no further use for (which itself would reduce the pressure behind the projectile), the current invention provides locking mechanisms to precisely intercept and eliminate rearward cartridge travel in those embodiments whose structure or comparative explosive potential of charges in different stages makes that an issue, are provide a rock solid foundation for these subsequent charges.

However, virtually perfect timing is required to be assured that any mechanism capable of blocking the backward progress of the projectile is not in the way microseconds earlier when it would block its forward progress. Contacting and affecting a projectile that may be moving at thousands of feet per second is tricky business and, if not done using a means that assure synchronization, reliability and velocity will not be as great.

The current invention discloses several effective means to effect this critical level of timing. Others are also applicable.

Figure 8:
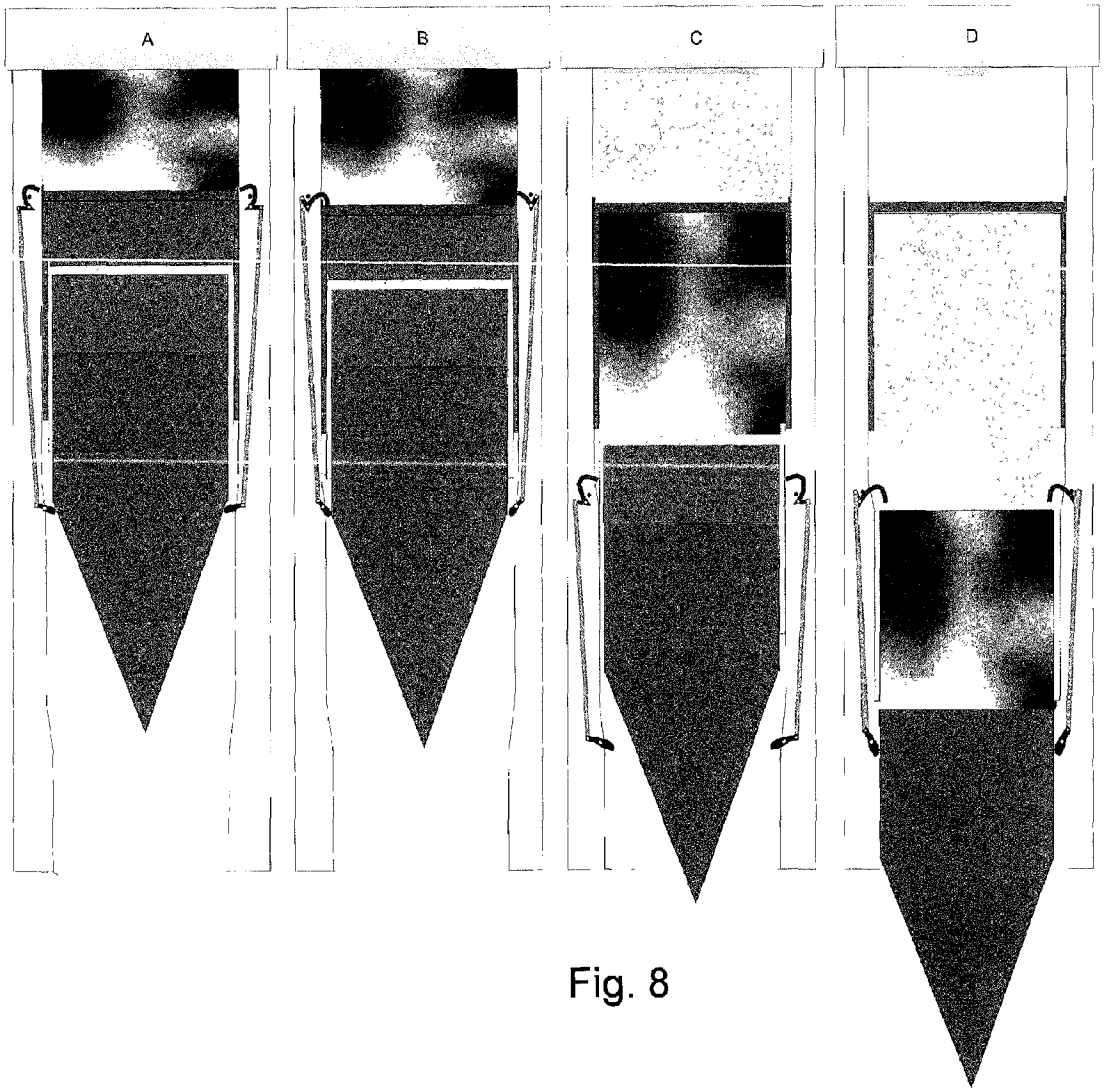
FIG. 8 illustrates a simple form of non-electronic secondary ignition initiation as well as a mechanical recoil containment mechanism. When the projectile encounters the contact levers, the combination firing pin and recoil lock arm is slammed into place firing the charge and preventing rearward motion. A sliding lock assembly or simple jam-in-place approach can be used to eliminate any regression. This regression is prevented, of course, by the contact lever being restrained by the projectile assembly but these additional elements not shown will reduce drag on the projectile and extend the life of the assembly for multi-use applications.

1. Expanding cartridges. By using soft-walled internal cartridge casings such as soft brass alloy shells ("internal" is noted here since the whole assembly could be called a multi-stage cartridge) designed to expand upon ignition of the charge but not enough to lodge in the trajectory channel until separation from the remaining portion(s) of the projectile has been accomplished, a very effective seal is accomplished and rearward motion at ignition is prevented thus dedicating all of the charge to increased projectile velocity. This will work best in single use applications where the barrel (or super-cartridge) is not reused and trapped effluent means behind the expanded cartridge is adequate (micro channels in the inner wall of the cartridge not unlike those in FIG. 4B, limited cartridge wall seal, etc.). For man-held high-penetrating devices, for example, the smaller projectile size would make considering the whole assembly a disposable cartridge practical. Since the expansion of the cartridge into the restraining wall can be designed to coincide with (actually to follow by a fraction of a millisecond) the separation of the cartridge from the payload it is pushing, this provides a means of synchronizing the separation event to the sealing event to maximize incremental velocity.
2. In hypervelocity cannons, however, the outside "cartridge" is an expensive piece of equipment and a reusable barrel (preferably the ones already in use) would be desirable i.e. one without expanded cartridges stuck in it. Also, in production models, the more reusable designs below may also have superior performance and sealing attributes for certain applications thus another means is synchronized mechanical containment with optional synchronized firing action as illustrated in FIG. 8. Ideally, while the second stage projectile was in flight, a containment arm or (for the purpose of igniting the already fast-moving target at precisely the right time) a firing pin optionally mounted on a strong enough support arm to act as a containment are, would come up from behind and, at just the appropriate microsecond, would strike the hurtling bullet with just the right amount of force relative to the projectiles velocity at precisely the right point. Simultaneously, with equal precision, some micro-timed means would instantly prevent rearward motion of the ignited casing at precisely the right point to ensure additive velocity. That is what this second means for synchronized firing shown in FIG. 8 does. The projectile itself in the embodiment shown as an example sets the timing without the use of any electrical switches, actuators, etc. This method is independent of and thus not vulnerable to the inevitable variances in load charge potential. Regardless of how rapidly the projectile is moving, the projectile itself will, by means such as the ones shown in FIG. 1, impact a purely physical series of levers (gears may also be included) which, based only on the precise position of the projectile itself, result in the direct impact of the firing "pin" on the appropriate portion on the cartridge (rim fire a shown here) at the precise time desired. Thus this option is applicable with or without electrical power being available to the firing device and is optionally reset-able for multiple firing (non-disposable cartridge) applications. It would seem that some velocity would be lost by this mechanical process. However, the energy required is very slight and, what energy is required, is, except for friction, all applied as impact (delivered by the firing rods) in the direction favored by the projectile. Multiple firing devices and/or containment devices such as these can be applied to each stage to provide sturdy and symmetrical containment and/or broad based firing reducing detonation time. For example, when using 3 such devices for a single stage, you would see, as you are looking down the barrel, the 3 firing assemblies (all sealed inside crevices in the barrel to prevent any loss of compression) taking the positions of the vertices of an equilateral triangle. When using 4 they would form a square. Firing from multiple sides simultaneously increases the immediacy of combustion and maximizes moment thus adding even more to velocity.

The firing assemblies as illustrated in FIG. 8 also include an optional one-way passage device (based on multi-lever bolt blocking rather than spring loading because springs do not respond quickly enough) that prevents the firing rods from being pushed backwards (until reset after the projectile has escaped for non-disposable applications) after the curved firing rod passes it.

Thus the multiple, sturdy firing rods themselves both fire the additional stage with precision and lock in the already achieved velocity of the projectile (by locking in the forward progress of the cartridge which is still its base of propulsion support) at precisely the correct position while adding (actually returning pre-invested moment) minor velocity with the impact.

Since the positions of these firing devices may, in shorter length embodiments, overlap for the second and third stages, etc., subsequent firing devices for each subsequent stage can be offset from the one(s) prior in order to prevent that overlap (simple rotate that triangle or square mentioned above between the stages).

Figure 2:
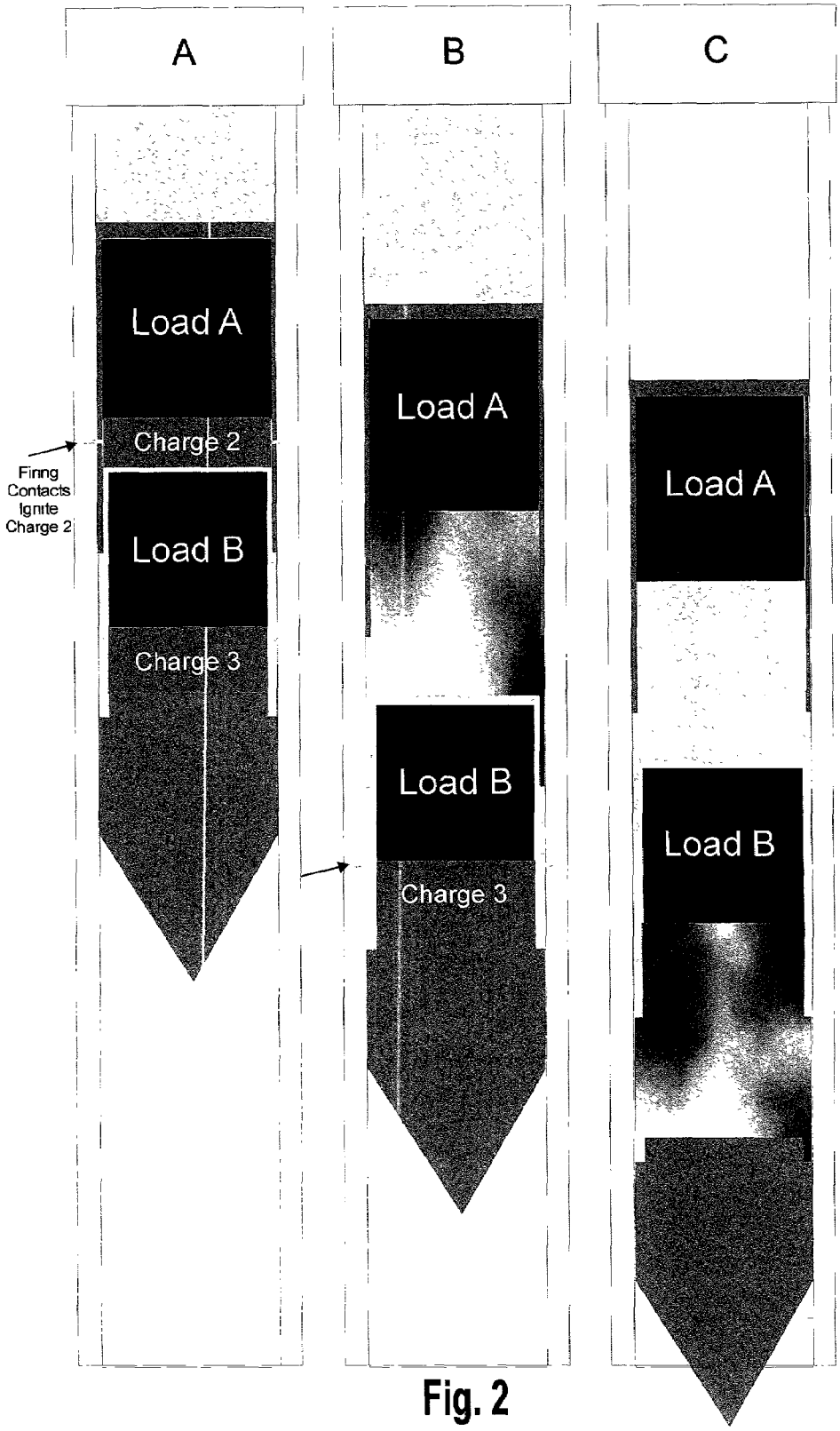
FIG. 2 adds a load A and B illustrating an embodiment that uses the first charge to create more momentum (from the extra weight ahead of each explosion) both to allow enhanced velocity increases from charges 2 and 3 and, optionally, to be used for a final conversion of mass to velocity as it leaves the muzzle as shown in later illustrations.

Other options: Spring loaded flight guides (stabilizers) may be used to do double duty by, after popping up (which can also be by bolt reflex action rather than the slower spring response), resisting rearward travel of the cartridge as shown in FIG. 2 labeled ("Flight guide and reversal restraint"). The spring loaded version, when independent of the firing rod assembly, will perform well for some applications despite the speed of spring loading because multiple flight guides can be spaced over the area providing more room for error and acceptable back movement of the cartridge.

For more instantaneous response and closer timing, lever actuated (like the firing pins shown in FIG. 8), slide-bolt (2 or 3 piece systems that lock into place) or jamming levers (that drive into wedges upon positioning to prevent reversal of the lever) or other direct mechanical reversal resistors not based on springs can also provide fast, precisely timed insertion of backward motion containment blocks.

Electrical or high energy photon firing. The process of synchronized firing can also be accomplished by electronic, laser or other non-impact ignition means based either upon known timing procedures using light beam interruption, wire separation to direct an ignition, direct brush electrical contact with electro-sensitive areas on the cartridge cap, etc.

Figure 9:
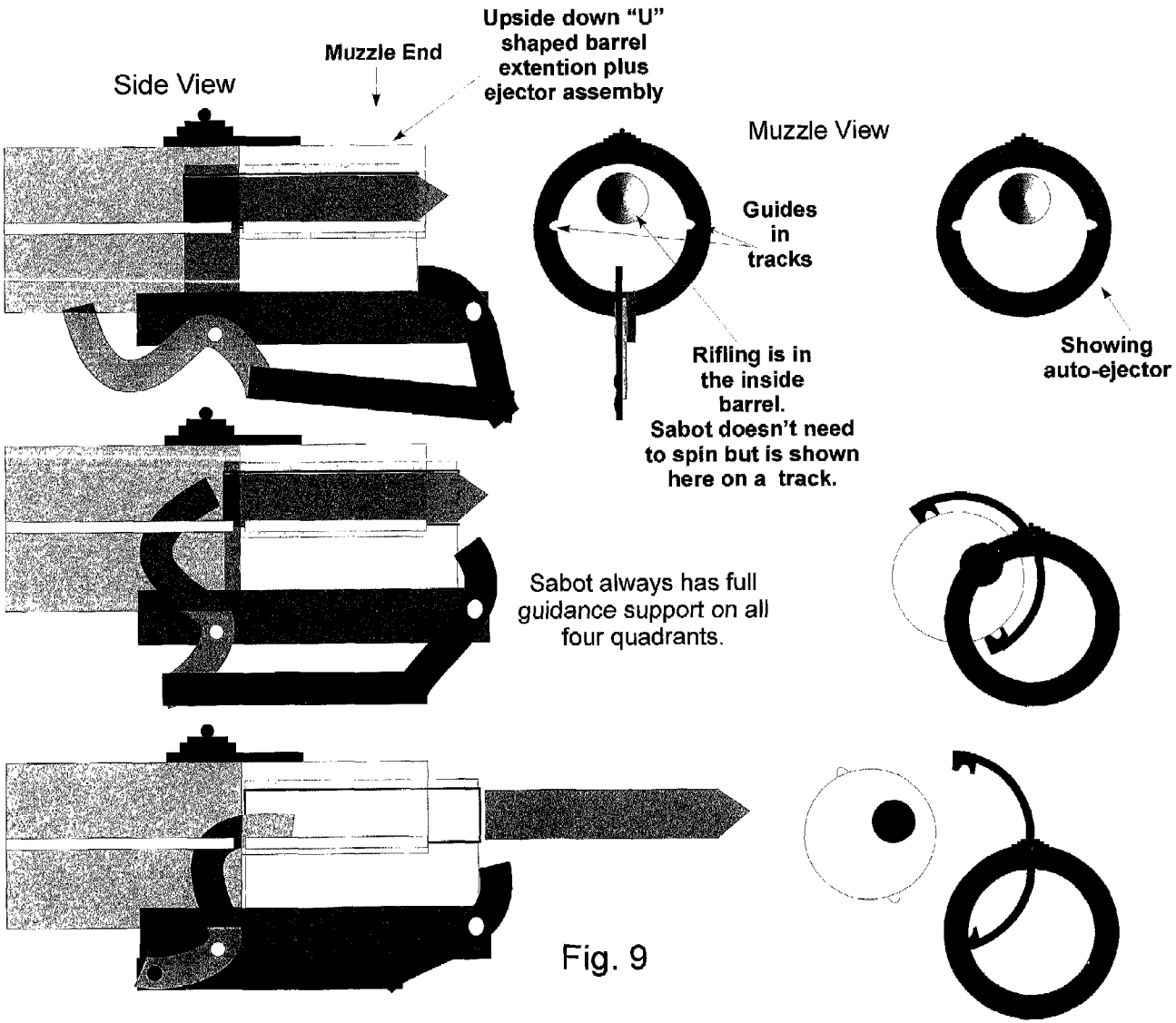
FIG. 9 illustrates a simple lever-based momentum-to-velocity converter at muzzle point with one embodiment of an auto-ejector ejecting the spent Sabot to the right of the user.

The assembly and process for leveraging the instantaneous conversion of mass for velocity as the projectile leaves the muzzle, described above using hydraulics as the leveraging means, is also practical using other forms of leverage including levers, gears, and pulleys. One embodiment using levers is illustrated in FIG. 9

Having described the invention, modifications will be evident to those skilled in the art without departing from the scope of the invention as defined in the appended claims.

What is claimed is:

1. A device for accelerating a projectile consisting of:

a projectile; and a carrier for carrying the projectile; and an acceleration means to move the projectile and its carrier effectively together; and an effectively anchored apparatus to encounter the moving projectile carrier with said apparatus having an unblocked path to allow the largely unrestrained projectile to continue in its path past said apparatus; and a hydraulic means for receiving, as the carrier impacts the anchored apparatus, the energy of that impact and transmitting that energy through the hydraulic means to the rear of the projectile; whereby the already moving projectile is further accelerated.

2. The device of claim 1 wherein:

the hydraulic means has a movable diaphragm which impacts the anchored apparatus thus transmitting the energy as compression within a nearby chamber whose outlet impacts the rear of the projectile.

3. The device of claim 2 wherein:

a medium inside the compression chamber is an explosive and is ignited as the projectile reaches the muzzle; whereby additional propulsion is achieved.

4. The device of claim 1 wherein:

the content of the hydraulic means is an explosive whose ignition is the result of the impact; whereby additional propulsion is achieved.

5. The device of claim 1 further comprising:

a sealed area in advance of the projectile's path for containing a vacuum; and vacuum creation means, operatively connected to and powered by acceleration means, for creating a vacuum in the sealed area; whereby air resistance is reduced in advance of the projectile facilitating less restrained acceleration prior to the projectile's exit from the sealed chamber.

6. A method for accelerating a projectile comprising the steps of:

(a) accelerating a projectile and carrier together, (b) slowing or stopping the carrier by an encounter with a restrictive contact element located essentially in the path of the oncoming carrier, (c) conducting the carrier's kinetic energy from the restrictive contact element through a leveraging device, (d) pushing the back or trailing end of the projectile from the faster moving portion of the leveraging device, and (e) adding more velocity to the already moving projectile.

* * * * *